United States Patent [19]

Smyth et al.

[11] Patent Number: 4,576,220

[45] Date of Patent: Mar. 18, 1986

[54] METHOD AND APPARATUS FOR MAINTAINING AN ATMOSPHERE AROUND A PREDETERMINED PORTION OF AN ENDLESS DISCRETE OBJECT CONVEYOR

[75] Inventors: Laurence C. Smyth, Beaconsfield; George Deep, Pointe-Claire, both of Canada

[73] Assignee: Noranda Inc., Toronto, Canada

[21] Appl. No.: 564,823

[22] Filed: Dec. 23, 1983

[51] Int. Cl.[4] ..... B22D 7/00; B22D 23/00

[52] U.S. Cl. ..... 164/66.1; 164/130; 164/259; 164/323; 164/335

[58] Field of Search ..... 164/66.1–68.1, 164/259, 4.1, 457, 415, 475, 130, 323, 335

[56] References Cited

U.S. PATENT DOCUMENTS

| | | | |
|---|---|---|---|
| 2,099,208 | 11/1937 | Horsfall et al. | 164/259 |
| 3,284,859 | 11/1966 | Conlon et al. | 164/415 |
| 3,603,378 | 9/1971 | Yearley | 164/415 |
| 4,030,532 | 6/1977 | Tiberg | 164/66.1 |

FOREIGN PATENT DOCUMENTS

| | | |
|---|---|---|
| 1160017 | 12/1983 | Canada . |
| 0088701 | 9/1983 | European Pat. Off. . |

*Primary Examiner*—Nicholas P. Godici
*Assistant Examiner*—J. Reed Batten, Jr.
*Attorney, Agent, or Firm*—Fleit, Jacobson, Cohn & Price

[57] ABSTRACT

An apparatus for maintaining a particular atmosphere above a predetermined portion of a train of closely spaced open top containers mounted on an endless conveyor chain, comprises a cover plate located at a predetermined distance above a number of such containers and extending before and after such predetermined portion. The cover plate has a predetermined number of ports therein for feeding a gas through the cover plate to progressively develop a particular atmosphere in the containers as they approach the predetermined portion of the endless conveyor and to maintain such atmosphere in the containers as they pass such predetermined portion.

16 Claims, 9 Drawing Figures

METHOD AND APPARATUS FOR MAINTAINING AN ATMOSPHERE AROUND A PREDETERMINED PORTION OF AN ENDLESS DISCRETE OBJECT CONVEYOR

This invention relates to an apparatus for maintaining a particular atmosphere around a predetermined portion of a train of closely spaced open top containers mounted on an endless conveyor chain.

In many continuous processes involving discrete objects, it is desirable to maintain a particular atmosphere around the process coveyance for some portion of the process. An example is the casting of molten metal into discrete ingot moulds on a continuous ingot moulding machine where it is desirable to pour the metal under an inert atmosphere to avoid oxidation of the metal as disclosed in Canadian Patent Application no. 358,379 filed Aug. 15, 1980. As it is disclosed in the above patent application, this may be done by placing a hood surrounding the casting machine at the metal pouring station and maintaining an inert atmosphere inside the hood. However, seals must be provided at the hood entrance and exit as well as on the sides of the hood to prevent excessive loss of inert gas.

It is difficult to maintain an atmosphere on endless conveyors since the methods of sealing must be capable of coping with the continuous wear caused by movement of the conveyor. This problem is particularly severe in molten metal operations where the high temperature involve detrimentally affect the life of contact sealing materials.

It is therefore the object of the present invention to provide a reliable, maintenance free apparatus for maintaining an atmosphere around a predetermined portion of an endless conveyor, especially with minimum sealing temperature restrictions.

The apparatus, in accordance with the present invention, for maintaining a particular atmosphere above a predetermined portion of a train of closely spaced open top containers mounted on an endless conveyor chain, comprises a cover plate located at a predetermined distance above a number of such containers and extending before and after such predetermined portion. The cover plate has a predetermined number of ports therein for feeding a gas through the cover plate to progressively develop a particular atmosphere in the containers as they approach the predetermined portion of the endless conveyor and to maintain such atmosphere in the containers as they pass such predetermined portion.

The entrance length of the cover plate before the predetermined portion develops the required atmosphere in the predetermined portion while the exit length of the cover plate is necessary to maintain the required atmosphere. The entrance length is determined by the conveyor line speed, the container volume, the container to cover gap and the influence of these factors on the volume of purging gas required to obtain the desired atmosphere. The exit length is determined by the pneumatic resistance required to prevent back flow of air into the predetermined portion. The width of the cover plate as well as the width of the container with respect to the container cavity are also dependent on the pneumatic resistance required to prevent back flow of air into the predetermined portion.

In an embodiment of the invention the containers are ingot moulds and means are provided for casting molten metal in each mould through an opening in the cover plate at such a predetermined portion of the train of ingot moulds. The gas atmosphere is non oxidizing and preferably provided by a nitrogen gas.

At a conveyor line speed of 2 in/sec., and using 56 pound ingot moulds, it has been found that the length of the plate is preferably equal to that required to cover five moulds (three before and two after the mould filling point). The distance between the plate and the top of the moulds was less than 0.3 inch and the gas flow rate less than 2,000 SCFH.

The invention will now be disclosed, by way of example, with reference to the accompanying drawings in which.

Figures 1, 3:
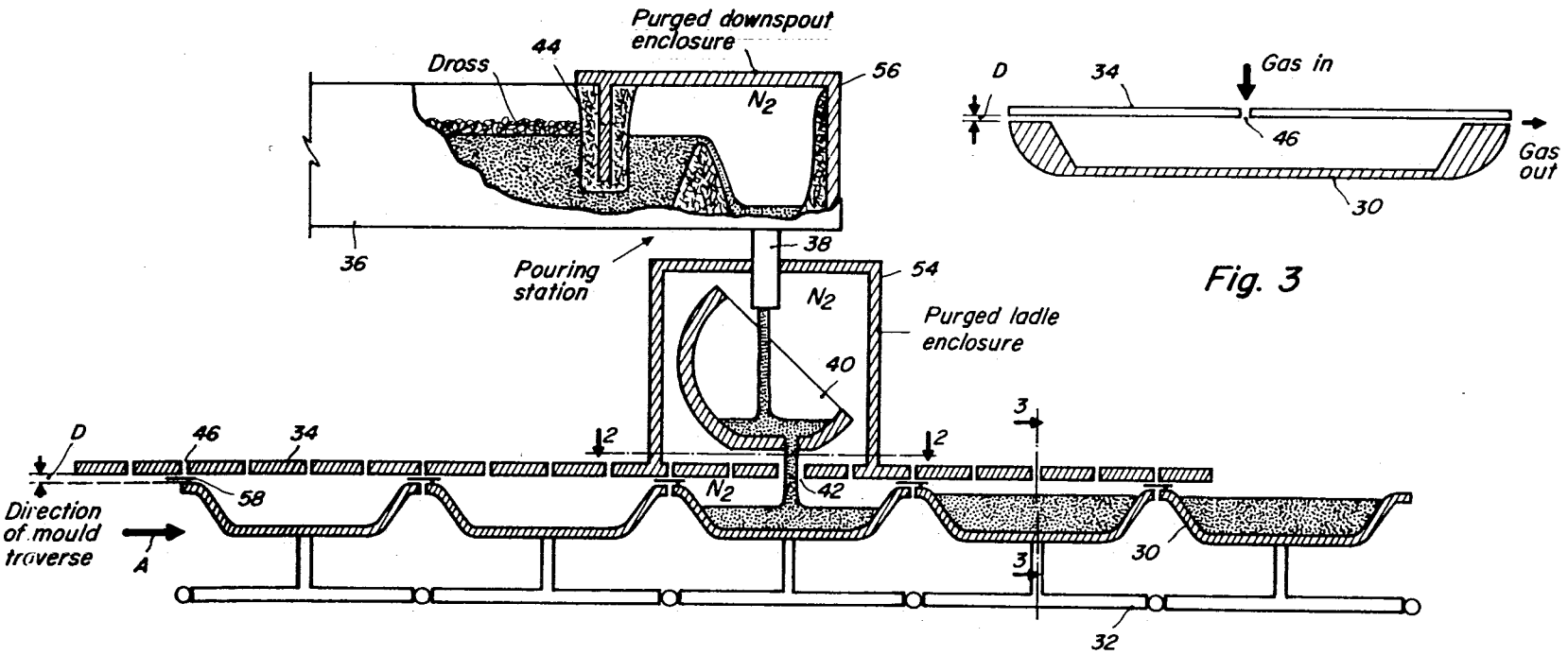
FIG. 1 is an example of an apparatus in accordance with the present invention used in the casting of molten metal into discrete moulds on a continuous ingot moulding machine.
FIG. 3 is a view taken along line 3—3 of FIG. 1.

Referring to FIG. 1 of the drawings, there is shown a train of closely spaced open top ingot moulds 30 mounted on an endless conveyor chain 32 moving at a line speed of about 2 in/sec. in the direction of arrow A. The ingot moulds all have flat top surfaces. A stationary cover plate 34 is mounted adjacent to but spaced by a predetermined distance D from the top surface of the moulds and covers a predetermined number of moulds before and after a metal pouring station which is mounted on the top of the cover plate. The metal pouring station is a conventional design comprising a launder 36 which ends with a downspout 38 used to feed molten metal into a ladle 40. The ladle 40 is intermittently pivoted to successively pour metal into each mould through a pouring slot 42 in the cover plate. A trap 44 is positioned at the end of the launder to capture dross which may be floating on the surface of the molten metal.

Figure 2:
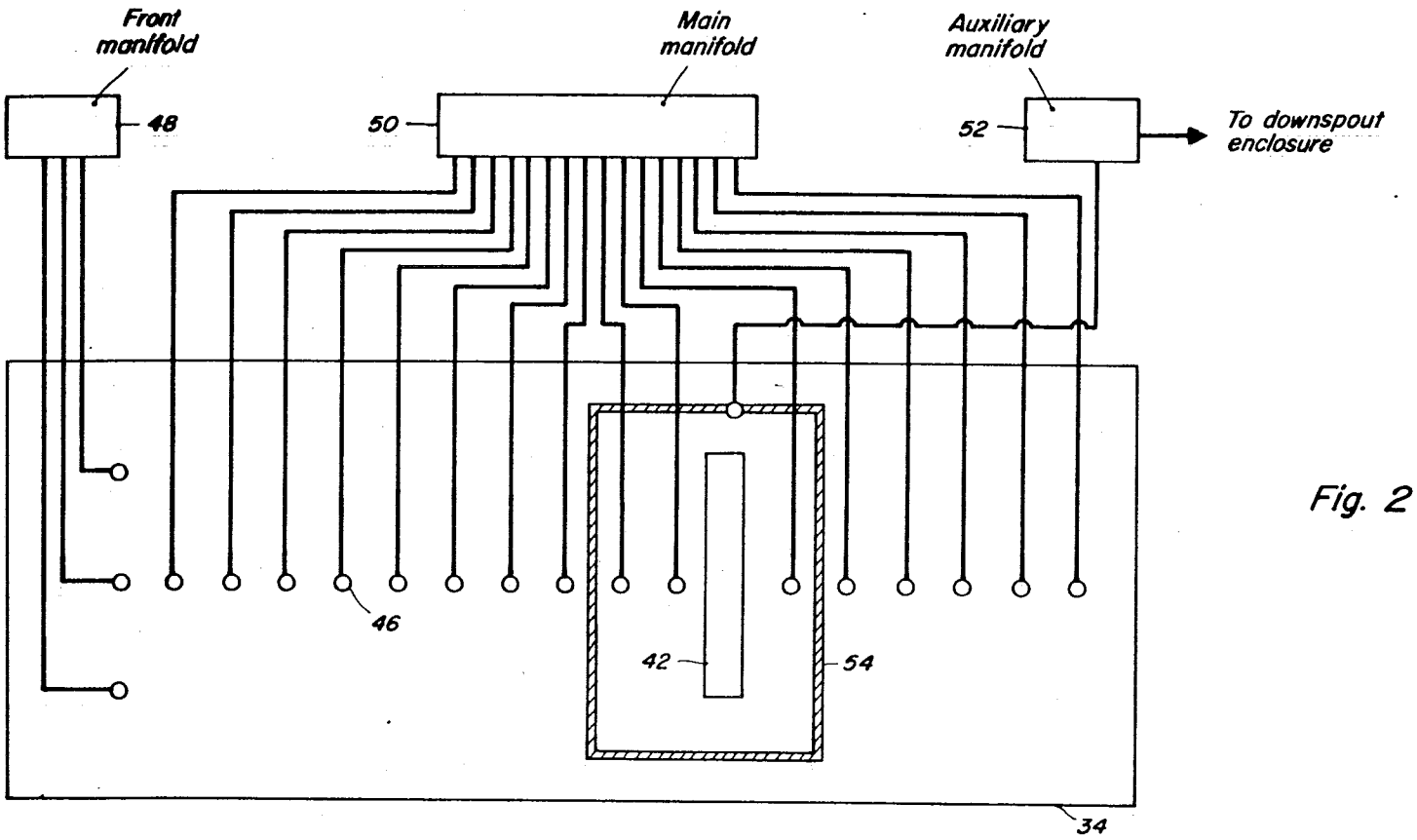
FIG. 2 is a view taken along line 2—2 of FIG. 1.

As shown in FIG. 2, the cover plate 34 is provided with a predetermined number of gas inlet ports 46 and an inert gas is fed into such ports through a front manifold 48 and a main manifold 50. Inert gas is fed to the front mould entering under the plate through three gas inlet ports to rapidly purge the moulds, and to the remaining moulds under the plate through a single row of ports to progressively lower and maintain the oxygen level at the pouring station below a predetermined value. An auxiliary manifold 52 is also provided for feeding inert gas to the ladle enclosure 54 and the downspout enclosure 56. Cover strips 58 are placed on the gaps between the moulds so as to prevent excessive leakage of gas through such gaps.

As shown in FIG. 3, the width of the plate 34 is equal to that of moulds 30. Inert gas enters the moulds at gas ports 46 and flows out through the gaps at the sides and the ends of the cover plate.

It has been found that by controlling the length of the cover plate 34, the number and location of gas emission ports, the gas flow rate and the gap between the moulds and the cover plate, a desired inert atmosphere can be maintained below the pouring slot 42 without having to use contacting seals. To facilitate investigation of the gas inlet port spacing, gap dimension and inert gas (nitrogen) flow rate, an apparatus was designed in the laboratory to simulate a conventional casting machine. The number of gas inlet ports in the cover plate was set so that, at any time there was a minimum of three and a maximum of four gas ports above a traversing mould. The length of the cover plate was such that at any time five moulds (three before and two after pouring slot 42) were located under the cover plate.

The tests were carried out by establishing a predetermined nitrogen flow rate through the cover plate and then traversing the moulds past the cover plate at the same speed as a conventional casting machine conveyor (2 in/sec.). Each mould was progressively purged as it entered under the cover plate. The mould atmosphere was sampled in the centre of the mould by pumping a sample to an oxygen analyser as the mould approached the pouring slot.

Experiments were carried out to determine the oxygen concentration in the mould atmosphere (a) at varying mould to cover gap dimensions and constant nitrogen flow rates and (b) at varying nitrogen flow rates and constant gap dimension. The results of these trials are presented in FIGS. 4 and 5. The front manifold flowrate in the test shown in FIG. 4 was about 200 SCFH and the main manifold flowrate was about 1500 SCFH. In the test shown in FIG. 5, the front manifold flowrate was fixed at about 200 SCFH and the main manifold flowrate was varied from 500 to 3000 SCFH.

Figure 5:
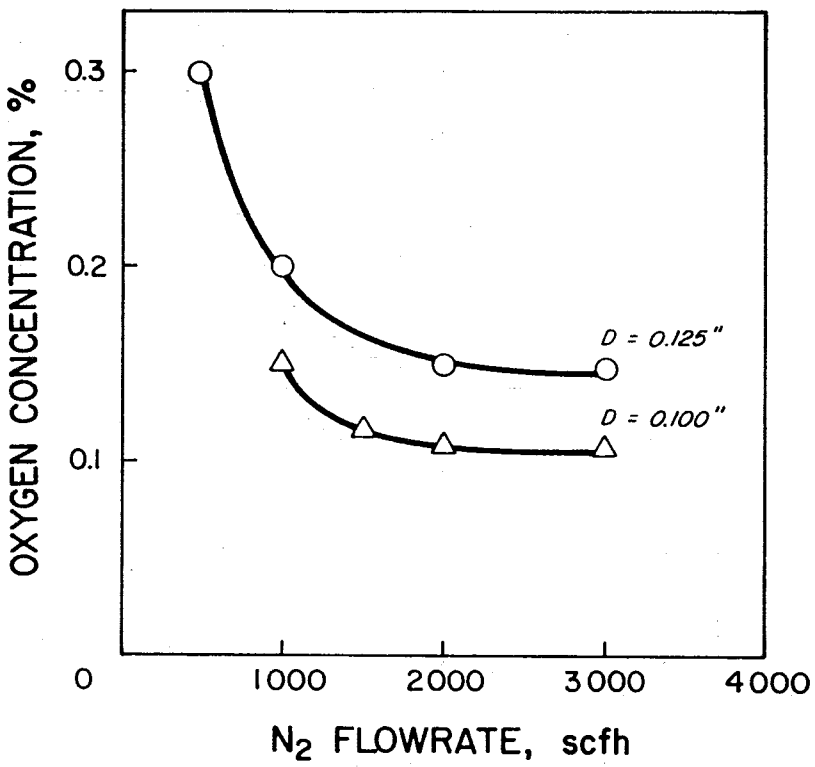
FIG. 5 is a graph illustrating the effect of varying nitrogen consumption on oxygen level in mould atmosphere for two different gap dimensions.
Figure 4:
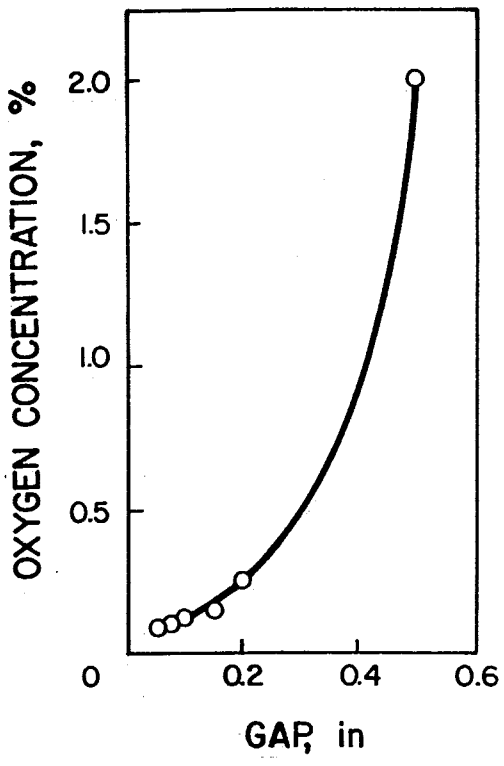
FIG. 4 is a graph illustrating the effect of varying gap dimension on oxygen level in mould atmosphere for a fixed nitrogen consumption.

The results of the tests presented in FIG. 4, revealed that the oxygen level increased very rapidly for gap dimensions greater than 0.25 in. More importantly, this curve illustrates that less than 0.5% oxygen can be achieved with gaps up to 0.3 in with economically feasible gas consumption (~2000 SCFH). The effect of varying nitrogen consumption on the oxygen level in the mould atmosphere is illustrated in FIG. 5 for two different gap dimensions of 0.10 and 0.125 in. From these curves, it is evident that no gain is achieved by increasing atmosphere usage beyond 2000 SCFH and that acceptable oxygen levels are easily obtained with very low (1000 SCFH) gas consumption. The gap heights of 0.10 and 0.125 in. used in these tests are practical values which can be achieved and maintained on present casting machines. Closer tolerances, which should be aimed for in the design of future casting machines can result in less than 0.1% oxygen with economical usage.

Following completion of the above pilot plant tests, equipment such as shown in FIG. 1 was installed on a slab ingot casting machine at Canadian Electrolytic Zinc Limited, Valleyfield, Quebec, Canada to demonstrate, under plant production conditions, that skimming-free slabs can be produced by pouring liquid zinc in a nitrogen atmosphere.

Atmosphere tests were initially carried out with the machine in operation but without pouring liquid metal. These tests indicated that oxygen levels could be maintained at the pouring station in the range of 0.3–0.5% and that no gain could be achieved by increasing the nitrogen flow rate above 2000 SCFH.

Liquid zinc was then started up with preheating flames on the launder and ladle. Nitrogen was first delivered at 250 SCFH to the front manifold and at 1500 SCFH to the main manifold of the cover plate and successively to the ladle and downspout enclosures at 250 SCFH. The oxygen level maintained at the pouring station was in the range of 0.35–0.45%.

Major reduction in the foam floating on cast slabs was observed even before start-up procedures were completed. Total absence of foam was achieved when the closure and purging of the ladle and launder enclosures were completed.

The slab ingot surfaces were seen to be bright and dross-free. Transparent oxide films identical to those obtained in the laboratory tests using oxygen levels in the range of 0.2–0.5% were observed on the slabs.

Figure 6:
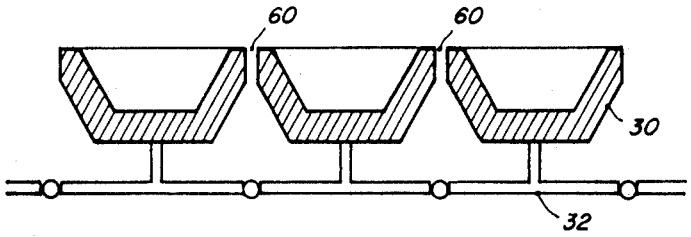
FIGS. 6 and 7 show mould refinements to reduce the gas flow requirement.
Figure 7:
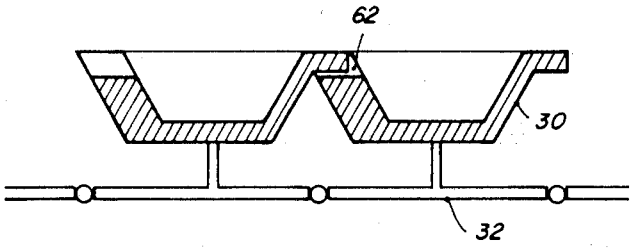
Figure 8:
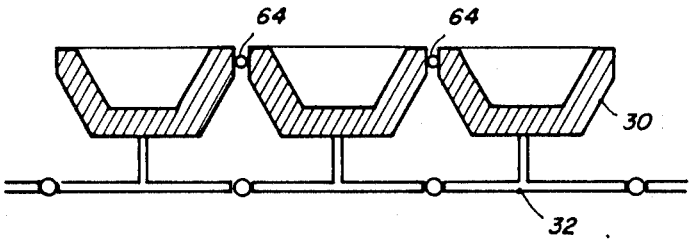
FIG. 8 shows another possible refinement which reduces gas flow but involves a non rubbing seal.

FIGS. 6, 7 and 8 show refinements to reduce loss of gas in between the moulds and so reduce the gas flow requirements. In FIG. 6, the edges of the moulds are thicker than that shown in FIG. 1 and this increases the resistance to gas flow in the gap 60 between the moulds. In FIG. 7, the edges of the moulds are designed so that the gap 62 is horizontal in order to prevent direct flow of the gas from the cover ports. This design is in a way equivalent to the cover strips 58 of FIG. 1 but is much more resistant to wear and tear. FIG. 8 shows another method of reducing gas flow which involves the use of a seal 64 in between the moulds. This alternative is possible since this seal is non rubbing.

Figure 9:
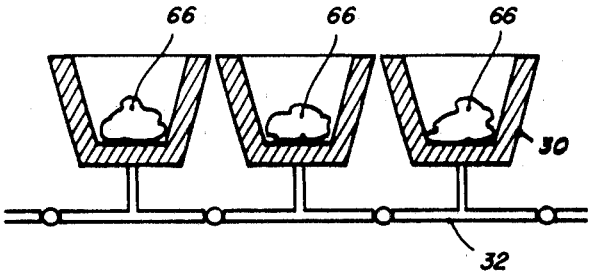
FIG. 9 illustrates how the basic principle of the invention can be used to maintain an atmosphere for handling discrete not necessarily metallic objects of varying sizes.

Although the invention has been disclosed with reference to the casting of molten metal and with the use of an inert gas, such as nitrogen, it is to be understood that this is a non limiting example. The apparatus in accordance with the present invention could be used to maintain any atmosphere (inert or not) around any discrete objects which are not necessarily metallic, contained in a train of open top containers as shown by discrete objects 66 in FIG. 9 of the drawings.

We claim:

1. An apparatus for maintaining a particular atmosphere above a predetermined portion of a train of closely spaced open top containers mounted on an endless conveyor chain, comprising:

(a) a cover plate located above a number of said containers and extending before and after said predetermined portion at a predetermined gap height between the top edge of each of the containers and the plate all around each container;

(b) a plurality of ports longitudinally spaced in said cover plate so that there is always at least one port over each container as the train of containers moves underneath the cover plate; and (c) means for feeding a gas through the ports in said cover plate to progressively develop a particular atmosphere in said containers as they approach the predetermined portion of the endless conveyor and to maintain said atmosphere in the containers as they pass through said predetermined portion without the use of contacting seals between the containers and the cover plate.

2. An apparatus as defined in claim 1, wherein said gap height is less than 0.3 in.

3. An apparatus as defined in claim 1, wherein said containers are ingot moulds and further comprising an opening through said cover plate at said predetermined portion and means for casting molten metal in each mould through the opening in said cover plate as the moulds move past the opening in said cover plate.

4. An apparatus as defined in claim 3, wherein said atmosphere is an inert atmosphere.

5. An apparatus for maintaining a particular atmosphere above a predetermined portion of a train of closely spaced open top containers mounted on an endless conveyor chain, comprising:

(a) a cover plate located above a number of said containers and extending before and after said predetermined portion at a predetermined gap height between the top edge of each of the containers and the cover plated all around each container;

(b) a plurality of ports longitudinally spaced in said cover plate so that there is always at least one port over each container as the train of containers passes underneath the cover plate;

(c) manifold means attached to said ports, and (d) a source of gas feeding a gas to said manifold means whereby said gas is fed through the ports in said cover plate to progressively develop a particular atmosphere in the containers as they approach the predetermined portion of the endless conveyor, and to maintain said atmosphere in the containers as said containers pass through said predetermined portion without the use of contacting seals between the containers and the cover plate.

6. An apparatus as defined in claim 5, further comprising sealing means disposed across the gaps between said open top containers, thereby preventing excessive leakage of gas through said gaps.

7. An apparatus as defined in claim 6, wherein said sealing means comprises thickened edges of said containers, whereby resistance to gas flow in the gap is increased.

8. An apparatus as defined in claim 5, wherein said sealing means comprises an overlapping edge, said overlapping edge disposed across the corresponding edge of the adjacent container, thereby creating a horizontal gap and preventing direct flow of gas from said ports.

9. An apparatus as defined in claim 6, wherein said sealing means comprises a cover strip, said cover strip attached to an edge of said container, and extending across said gap and over the corresponding edge of the adjacent container.

10. An apparatus as defined in claim 5, wherein said containers are ingot moulds and further comprising an opening through said cover plate at said predetermined portion and means for casting molten metal in each mould through the opening in said cover plate as the moulds move past the opening in said cover plate.

11. An apparatus as defined in claim 10, wherein said manifold means also is attached to said casting means, whereby a gas is fed into the immediate environment around said casting means to develop and maintain the desired atmosphere.

12. An apparatus as defined in claim 9, wherein said atmosphere is an inert atmosphere.

13. A method for maintaining a particular atmosphere above a predetermined portion of a train of closely spaced open top containers mounted on an endless conveyor chain, such method comprising the steps of:

(a) determining the particular atmosphere to be maintained above said predetermined portion;

(b) locating a cover plate above a number of said containers and extending before and after said predetermined portion at a predetermined gap height between the top edge of each of the containers and the cover plate all around each container;

(c) providing a plurality of ports longitudinally spaced in said cover plate so that there is always at least one inlet port over each container as the containers pass underneath the cover plate;

(d) passing said containers at a predetermined speed under said cover plate through said predetermined portion; and (e) feeding a gas through the ports in said cover plate at a predetermined flow rate to progressively develop the particular atmosphere in the containers as they approach said predetermined portion and maintain said atmosphere as said containers pass said predetermined portion without the use of contacting seals between the containers and the cover plate.

14. The method of claim 13, further comprising the steps of:

(a) casting molten metal in each container from a casting means housed in a casting means enclosure through an opening in said cover plate above the predetermined portion as said container is moved past said opening; and (b) feeding a gas through ports in the casting means enclosure, thereby developing and maintaining the particular atmosphere in the immediate environment of said casting means.

15. The method of claim 13, further comprising the step of feeding an inert gas through the ports in said cover plate.

16. The method of claim 13, wherein the gas flow rate is about 2000 SCFH and the gap height less than 0.3 in.

* * * * *